US009951580B2

(12) United States Patent
Moyes

(10) Patent No.: US 9,951,580 B2
(45) Date of Patent: Apr. 24, 2018

(54) WELL BARRIER METHOD AND APPARATUS

(71) Applicant: XTREME WELL TECHNOLOGY LIMITED, Banchory (GB)

(72) Inventor: Peter Moyes, Banchory (GB)

(73) Assignee: XTREME WELL TECHNOLOGY LIMITED, Banchory (GB)

( * ) Notice: Subject to any disclaimer, the term of this patent is extended or adjusted under 35 U.S.C. 154(b) by 0 days.

(21) Appl. No.: 15/123,966

(22) PCT Filed: Mar. 2, 2015

(86) PCT No.: PCT/GB2015/050592
§ 371 (c)(1),
(2) Date: Sep. 6, 2016

(87) PCT Pub. No.: WO2015/132567
PCT Pub. Date: Sep. 11, 2015

(65) Prior Publication Data

US 2017/0016304 A1 Jan. 19, 2017

(30) Foreign Application Priority Data

Mar. 5, 2014 (GB) ..... 1403918.4

(51) Int. Cl.

| | |
|---|---|
| ***E21B 33/138*** | (2006.01) |
| ***E21B 33/12*** | (2006.01) |
| ***E21B 33/13*** | (2006.01) |
| *E21B 17/06* | (2006.01) |
| *E21B 17/07* | (2006.01) |
| *E21B 33/128* | (2006.01) |
| *E21B 33/16* | (2006.01) |
| *E21B 36/00* | (2006.01) |

(52) U.S. Cl.
CPC ..... *E21B 33/138* (2013.01); *E21B 33/12* (2013.01); *E21B 33/1204* (2013.01); *E21B 33/13* (2013.01); *E21B 17/06* (2013.01); *E21B 17/07* (2013.01); *E21B 33/128* (2013.01); *E21B 33/16* (2013.01); *E21B 36/00* (2013.01)

(58) Field of Classification Search
CPC ..... E21B 33/12; E21B 43/103; E21B 33/138; E21B 33/16; E21B 33/13; E21B 43/105
See application file for complete search history.

(56) References Cited

U.S. PATENT DOCUMENTS

| | | | | |
|---|---|---|---|---|
| 7,527,095 | B2 * | 5/2009 | Bloess | E21B 33/134 166/228 |
| 2005/0217847 | A1 * | 10/2005 | Jones | E21B 43/108 166/278 |
| 2013/0105158 | A1 * | 5/2013 | Saltel | E21B 33/1204 166/290 |

FOREIGN PATENT DOCUMENTS

| | | | | |
|---|---|---|---|---|
| GB | WO 2012160380 | A2 * | 11/2012 | E21B 23/06 |
| NO | WO 9960250 | A1 * | 11/1999 | E21B 33/02 |
| WO | WO 9637682 | A1 * | 11/1996 | E21B 33/127 |

* cited by examiner

*Primary Examiner* — Zakiya W Bates
(74) *Attorney, Agent, or Firm* — Nixon & Vanderhye P.C.

(57) ABSTRACT

A method for setting a barrier within a wellbore comprises deploying a first plug assembly (16) into a wellbore on a running string, wherein the first plug assembly comprises an extendable arrangement (24), and then setting the first plug assembly within the wellbore by extending the extendable arrangement. A settable medium is injected via the running string into the wellbore above the first plug assembly. To be accompanied, when published, with FIG. 1F

20 Claims, 4 Drawing Sheets

WELL BARRIER METHOD AND APPARATUS

This application is the U.S. national phase of International Application No. PCT/GB2015/050592 filed Mar. 2, 2015, which designated the U.S. and claims priority to GB Patent Application No. 1403918.4 filed Mar. 5, 2014, the entire contents of each of which are hereby incorporated by reference.

FIELD OF THE INVENTION

The present invention relates to a method and apparatus for establishing a plug or barrier within a well, for example for use in well abandonment.

BACKGROUND TO THE INVENTION

In the oil and gas exploration and production industry there are many reasons for abandoning a well, including end-of-life decommissioning, isolating an exploration well and the like. Also, there may be occasions where long term suspension of a well is required, for example where reserves are located but production is not yet economically viable. Any wellbore decommissioning or abandoning (temporary or permanent) must follow legislation appropriate for the region in question. Such legislation typically calls for a robust barrier or plug to be set within the wellbore. In many cases a cement plug is often used, providing a barrier of low permeability, long term integrity and low levels of shrinking. Also, such legislation typically requires multiple barriers to be established, to provide contingency in the event of failure or compromise of one of these barriers.

There is a constant drive in the oil and gas industry to improve safety measures, including providing robust measures for setting and retaining in place wellbore barriers, for example for use in well abandonment or suspension.

SUMMARY OF THE INVENTION

According to an aspect of the present invention there is provided a method for setting a plug or barrier within a wellbore, comprising:

- deploying a first plug assembly into a wellbore on a running string, wherein the first plug assembly comprises an extendable arrangement;
- setting the first plug assembly within the wellbore by extending the extendable arrangement;
- releasing the running string from the first plug assembly; and
- injecting a settable medium via the running string above the first plug assembly.

It should be understood that terms such as "lower", "upper", "above", "below" and the like, as used herein, should not be understood to relate to purely vertical wellbore orientations and applications. Instead, the terms are intended to be defined relative to the associated wellbore, irrespective of its orientation, and in particular relative to an entry point of an associated wellbore. For example, a lower region of a wellbore may be positioned further from the entry point of the wellbore than an upper region. As such, the method or any associated apparatus may be utilised in combination with a wellbore of any orientation, from purely vertical, to purely horizontal, and any orientation therebetween. All other similar terms, unless otherwise defined, should be construed accordingly.

The settable medium may function to provide a suitable barrier within the wellbore. Such a barrier may isolate regions of the wellbore above and below said barrier. The settable medium may provide a suitable barrier before and/or after setting.

The method may comprise allowing the settable medium to set within the wellbore. The method may comprise providing a stimulus to permit the settable medium to set, for example a chemical stimulus, thermal stimulus or the like.

The settable medium may comprise cement. The settable medium may comprise an epoxy. The settable medium may comprise a gel or the like.

The settable medium may be originally provided in fluid or semi-fluid form, permitting said settable medium to be injected/flowed into the wellbore. Setting of the settable medium may prevent or minimise the capability of the settable medium to flow. Setting of the settable medium may comprise hardening of the settable medium.

The first plug assembly, when set, may function to retain the settable medium, for example a substantial portion of the settable medium, above said first plug assembly. Such an arrangement may permit the settable medium to be retained until set within the wellbore, for example.

The first plug assembly, once set, may provide an obstruction within the wellbore. Such an obstruction may function to prevent or substantially minimise by-pass of the settable medium once injected into the wellbore, to retain said settable medium above said first plug assembly.

The first plug assembly may be set within the wellbore by reconfiguring the extendable arrangement towards an extended position to engage a wall of the wellbore.

In some embodiments at least a portion of the extendable arrangement may non-sealingly engage the wall of the wellbore.

The first plug assembly, when set, may provide a seal with the wall of the wellbore.

The extendable arrangement of the first plug assembly, when extended, may sealingly engage the wall of the wellbore. In such an embodiment the extendable arrangement may define or comprise a sealing assembly.

The sealing engagement of the first plug assembly with the wall of the wellbore may function to prevent or substantially minimise by-pass of the settable medium once injected into the wellbore, to retain said settable medium above said first plug assembly. In such an arrangement the first plug assembly, once set, may define a set barrier within the wellbore. The first plug assembly, once set, may define a lower set barrier, whereas the settable medium may define an upper set barrier. Accordingly, with such an arrangement at least two barriers may be established, a first barrier achieved by the lower plug assembly when set, and a second barrier achieved by the settable medium when in place above the first plug assembly. Such an arrangement may provide a more robust overall barrier within the wellbore, providing a degree of contingency. Furthermore, providing multiple barriers in this way may also allow certain legislation requirements which might be in place to be met.

The extendable arrangement of the first plug assembly, when extended, may define an anchor within the wellbore.

The first plug assembly may comprise a first extendable arrangement which is configured to provide sealing with a wall of the wellbore, and a second extendable arrangement which is configured to provide an anchor within the wellbore.

The first plug assembly may be mechanically actuated to be set within the wellbore.

The first plug assembly may be fluid pressure actuated to be set within the wellbore.

In some embodiments the first plug assembly may be actuated by a first actuation object deployed through the running string and into the first plug assembly.

The first actuation object may be dropped, pumped or the like through the running string. In some embodiments the first plug assembly may be displaced through the running string towards the first plug assembly by the settable medium.

The first plug assembly may comprise a first seat configured to be engaged by the first actuation object. In this respect, the method may comprise landing or receiving the first actuation object on the first seat within the first plug assembly. Such engagement between the first seat and first actuation object may facilitate actuation of the first plug assembly. For example, momentum of the first actuation object may cause or initiate actuation of the first plug assembly. Alternatively, or additionally, fluid pressure acting behind the first actuation object when engaged on the first seat may cause or initiate actuation of the first plug assembly.

The first seat may be configured, for example sized and/or shaped, to cooperate with the first actuation object.

The first actuation object may be sealingly engaged within the first plug assembly, for example sealingly engaged with or within the first seat. This arrangement may prevent or substantially minimise bypass of the settable medium through the first plug assembly.

The first actuation object may comprise a ball.

The first actuation object may comprise a dart.

The first actuation object may comprise or define a cement dart.

The extendable arrangement may comprise a radially extendable structure. The radially extendable structure may be radially extended by application of an actuation force, for example provided or created by a first actuation object. In some embodiments the radially extendable structure may be extended by application of an axial force.

The radially extendable structure may comprise a deformable structure, configured to be deformed to become radially extended.

The radially extendable structure may comprise a bellows construction.

The radially extendable structure may be provided in accordance with WO 2013/079965, the disclosure of which is incorporated herein by reference.

The extendable arrangement may comprise a metal structure. In some embodiments where the extendable arrangement is provided to engage a metal wellbore structure, a metal-to-metal seal may be created.

The extendable arrangement may comprise a non-metal structure. In some embodiments the extendable structure may comprise a hybrid metal and non-metal construction.

The method may comprise injecting the settable medium after or during the step of releasing the running string from the first plug assembly. In some embodiments, releasing the running string from the first plug assembly may provide a communication path for the settable medium to be injected from the running string into the wellbore above the first plug assembly.

The method may comprise moving the running string, for example in an upward direction, following release form the first plug assembly.

The method may comprise injecting the settable medium above the first plug assembly during movement of the running string.

The running string may be moved within the wellbore following release form the first plug assembly by surface equipment, a tractor system or the like.

The running string may be moved within the wellbore during injection of the settable medium. For example, the injected settable medium may displace the running string.

The method may comprise providing a displacement barrier or restriction on the running string, wherein said displacement barrier may be acted upon by the settable medium during injection, to facilitate or assist with displacement of the running string along the wellbore.

The displacement barrier may comprise an extendable structure provided on or otherwise associated with the running string. The extendable structure may be activated to be extended prior to or during injection of the settable medium. The extendable structure may be pressure activated. The extendable structure may be mechanically activated. The extendable structure may be activated by an actuation object. For example, the actuation object may be the same object used to actuate the first plug assembly. The extendable structure may be activated by a drag force established by a volume of the injected settable medium passing over said extendable structure. Such passage of the injected settable medium may be achieved until the extendable structure is fully extended.

The displacement barrier may extend between the running string and engage a wall of the wellbore. Such an arrangement may provide a degree of isolation between the settable medium being injected and other resident wellbore fluids. This may minimise contamination of the settable medium, assisting to provide a more robust barrier once set.

The displacement barrier may function to wipe the wall of the wellbore during displacement of the running string. Such an arrangement may assist to facilitate a more robust bond between the settable medium and the wall of the wellbore.

The extendable structure for providing a displacement barrier may comprise one or more swab cups or the like. As will be described in more detail below, the extendable structure for providing a displacement barrier may comprise or be defined by an extendable arrangement of a second or further plug assembly.

A releasable connection may be provided between the running string and the first plug assembly.

The releasable connection may comprise a telescoping arrangement between the running string and the first plug assembly.

The releasable connection may be provided by a force failure mechanism. For example, the releasable connection may comprise a frangible connection member configured to fail upon exposure to a predetermined force, such as a tensile force, compressive force, torque or the like.

The releasable connection may be provided by a release mechanism. Such a release mechanism may be actuated to permit release upon application of a force, such as a tensile force, compressive force, torque or the like.

In some embodiments, the release mechanism may be activated by an object, such as the same object which actuates the first plug assembly.

The method may comprise including running a second plug assembly into the wellbore, for example on the same running string, above the first plug assembly. The second plug assembly may be configured similarly to the first plug assembly.

In some embodiments the first and second plug assemblies may be considered to form part of the running string when connected thereto.

The second plug assembly may be located immediately above the first plug assembly. Alternatively, the second plug assembly may be spaced from the first plug assembly, for example by a portion of running string, a further tool, or the like.

The second plug assembly may be released form the first plug assembly. Release of the second plug assembly may facilitate release of the running string from the first plug assembly. For example, the second plug assembly may be secured to the running string during release of the second plug assembly from the first plug assembly.

The method may comprise releasing the running string and the second plug assembly from the first plug assembly, and moving the second plug assembly relative to the first plug assembly. Such movement may be achieved in an upward direction within the wellbore. Such movement may increase an axial spacing between the first and second plug assemblies. The settable medium may be injected within the axial space between the first and second plug assemblies.

The running string and second plug assembly may be moved within the wellbore once released from the first plug assembly by surface equipment, a tractor system or the like.

The running string and second plug assembly may be moved within the wellbore once released from the first plug assembly during injection of the settable medium. For example, the injected settable medium may act to displace the second plug assembly and running string.

The method may comprise providing a displacement barrier or restriction on the running string, for example on the second plug assembly, wherein said displacement barrier may be acted upon by the settable medium during injection, to facilitate or assist with displacement of the running string and second plug assembly along the wellbore.

The method may comprise injecting the settable medium above the first plug assembly and below the second plug assembly. For example, the settable medium may be injected and positioned within the wellbore intermediate the first and second plug assemblies.

The second plug assembly may comprise an extendable arrangement. The method may comprise setting the second plug assembly within the wellbore by extending the extendable arrangement.

The method may comprise setting the second plug assembly during or after injection of the settable material.

The second plug assembly, once set, may provide an obstruction within the wellbore. Such an obstruction may function to prevent or substantially minimise by-pass of the settable medium once injected into the wellbore, to retain said settable medium below said second plug assembly.

The second plug assembly may be set within the wellbore by reconfiguring the extendable arrangement towards an extended position to engage a wall of the wellbore.

In some embodiments at least a portion of the extendable arrangement of the second plug assembly may non-sealingly engage the wall of the wellbore.

The second plug assembly, when set, may provide a seal with the wall of the wellbore.

The extendable arrangement of the second plug assembly, when extended, may sealingly engage the wall of the wellbore. In such an embodiment the extendable arrangement may define or comprise a sealing assembly.

The sealing engagement of the second plug assembly with the wall of the wellbore may function to prevent or substantially minimise by-pass of the settable medium once injected into the wellbore, to retain said settable medium below said second plug assembly. In such an arrangement the second plug assembly, once set, may define a set barrier within the wellbore. Accordingly, with such an arrangement at least three barriers may be established: a first barrier achieved by the first plug assembly when set; a second barrier achieved by the settable medium when in place between the first and second plug assemblies; and a third barrier achieved by the second plug assembly when set. Such an arrangement may provide a more robust overall barrier within the wellbore, providing a degree of contingency. Furthermore, providing multiple barriers in this way may also allow certain legislation requirements which might be in place to be met.

The extendable arrangement of the second plug assembly, when extended, may define an anchor within the wellbore.

The second plug assembly may comprise a first extendable arrangement which is configured to provide sealing with a wall of the wellbore, and a second extendable arrangement which is configured to provide an anchor within the wellbore.

The second plug assembly may be mechanically actuated to be set within the wellbore.

The second plug assembly may be fluid pressure actuated to be set within the wellbore.

In some embodiments the second plug assembly may be actuated by a second actuation object deployed through the running string and into the second plug assembly. In such an arrangement, a first actuation object may be permitted to pass through the second plug assembly without setting the associated extendable arrangement, allowing the first actuation object to continue to actuate the first plug assembly.

The second actuation object may be dropped, pumped or the like through the running string. In some embodiments the second actuation object may function to displace the settable material along the running string. The second actuation object may itself be displaced through the running string towards the second plug assembly by a displacement fluid, such as a mud, water or the like. In such an embodiment the displacement fluid may also function to displace the settable medium, via the second actuation object.

The method may comprise providing a volume of settable medium between first and second actuation objects, wherein the first and second actuation objects and the settable medium are displaced through the running string by a displacement fluid, such as a mud, water or the like. The first actuation object may facilitate actuation or setting of the first plug assembly. The second actuation object may facilitate injection of the settable medium into the wellbore, for example after releasing the running string from the first plug assembly. The second actuation object may function to actuate or set the second plug assembly.

The second plug assembly may comprise a second seat configured to be engaged by the second actuation object. In this respect, the method may comprise landing or receiving the second actuation object on the second seat within the second plug assembly. Such engagement between the second seat and second actuation object may facilitate actuation of the second plug assembly. For example, momentum of the second actuation object may cause or initiate actuation of the second plug assembly. Alternatively, or additionally, fluid pressure acting behind the second actuation object when engaged on the second seat may cause or initiate actuation of the second plug assembly.

The second seat may be configured, for example sized and/or shaped, to cooperate with the second actuation object. The second seat may be configured, for example sized and/or shaped, to permit a first actuation object to pass therethrough to progress towards the first plug assembly. In such an arrangement, the second seat may be larger than a first seat located within the first plug assembly.

The second actuation object may be sealingly engaged within the second plug assembly, for example sealingly engaged within the second seat. This arrangement may prevent or substantially minimise bypass of the settable medium through the second plug assembly.

The second actuation object may comprise a ball.

The second actuation object may comprise a dart.

The second actuation object may comprise or define a cement dart.

The extendable arrangement of the second plug assembly may comprise a radially extendable structure. The radially extendable structure may be radially extended by application of an actuation force, for example provided or created by a second actuation object. In some embodiments the radially extendable structure may be extended by application of an axial force.

The radially extendable structure may comprise a deformable structure, configured to be deformed to become radially extended.

The radially extendable structure may comprise a bellows construction.

The radially extendable structure may be provided in accordance with WO 2013/079965, the disclosure of which is incorporated herein by reference.

The extendable arrangement may comprise a metal structure. In some embodiments where the extendable arrangement is provided to engage a metal wellbore structure, a metal-to-metal seal may be created.

The extendable arrangement may comprise a non-metal structure. In some embodiments the extendable structure may comprise a hybrid metal and non-metal construction.

The method may comprise extending, for example at least partially extending the extendable arrangement of the second plug assembly to define a displacement barrier. The extendable arrangement may slidingly contact a wall of the wellbore. This defined displacement barrier may assist to permit injected settable medium to act against the displacement barrier to displace or drive the second plug assembly and running string along the wellbore.

In embodiments where the extendable arrangement of the second plug assembly is only partially extended to provide a displacement barrier, the method may comprise subsequently fully or more completely extending the extendable arrangement to set the second plug assembly within the wellbore.

The method may comprise:

setting the first plug assembly within the wellbore by extending the extendable arrangement;

releasing the running string and the second plug assembly from the first plug assembly;

injecting the settable medium via the running assembly above the first plug assembly;

moving the running string and the second plug assembly relative to the first plug assembly; and setting the second plug assembly within the wellbore by extending the extendable arrangement.

The method may comprise releasing the running string from the second plug assembly. The method may comprise withdrawing the running string from the wellbore.

The method may optionally comprising providing further plug assemblies, for example a third, fourth and so on. Each additional plug assembly may be utilised in a similar manner as described in connection with the second plug assembly.

The method may be used to provide a barrier within an open hole section of a wellbore.

The method may be used to provide a barrier within a cased or lined section of a wellbore.

The method may comprise setting a barrier within a perforated tubular (such as a casing tubular, liner tubular or the like) located within the wellbore. In such an arrangement the method may comprise injecting the settable medium through one or more perforations in the tubular. This arrangement may permit the settable medium to also provide a barrier in an annular region positioned around the outside of the tubular. This may allow a more robust barrier to be achieved, for example by eliminating possible leak paths which could otherwise exist along the annulus.

The method may comprise perforating a tubular within the wellbore, and then setting the barrier in the region of the perforations.

The method may comprise running a perforating apparatus, such as a perforating gun apparatus into the wellbore and perforating a tubular within the wellbore and then setting the barrier. In some embodiments the perforating apparatus may be run into the wellbore on the same running string as the first plug assembly. For example, the perforating apparatus may be located below the first plug apparatus. Alternatively, or additionally, the perforating apparatus, or portions thereof, may be located above the first plug assembly.

The running string may comprise tubing, for example coiled tubing, drill pipe or the like.

The settable medium may be delivered from surface.

Alternatively, or additionally, the settable medium may be delivered from a downhole location, for example form a downhole storage location. In some embodiments the running string may comprise a storage region configured to store a volume of settable medium.

The method may comprise setting a barrier during a well abandonment operation.

The method may comprise setting a barrier in a previously producing well.

The method may comprise setting a barrier in a well previously used for injection purposes.

The method may comprise setting a barrier as part of a wellbore construction operation, for example to form part of a wellbore completion system. For example, in some exemplary uses, the present method may be utilised to set a barrier in a toe region of a wellbore. This may assist in well control during production and/or injection operations.

The first and/or second plug assembly may be removable. In some embodiments the first and/or second plug assembly may be drillable. This may permit a barrier to be removed after setting.

An aspect of the present invention relates to an apparatus for establishing a barrier within a wellbore, comprising:

a first plug assembly comprising an extendable arrangement, wherein the first plug assembly is configured to be set within a wellbore by extending the extendable arrangement;

a running string releasably connected to the first plug assembly, wherein the running string defines an injection path to permit a settable medium to be injected into a wellbore.

The apparatus may be utilised to carry out the method according to any other aspect. Accordingly, the apparatus may optionally include any feature presented or described in relation to any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Aspects of the present invention relate to a method and apparatus for creating a barrier in a wellbore. There are multiple situations where such a barrier may be required or is advantageous. However, for the purposes of the present exemplary description, an example apparatus will be described for use in setting a barrier in a wellbore during well abandonment.

FIGS. 1A to 1F diagrammatically illustrate sequences of a method of setting a barrier in a wellbore utilising an apparatus 10 according to an exemplary embodiment of the present invention. In the present embodiment the wellbore includes a string of tubing 12, such as casing, although it should be recognised that in other embodiments the wellbore may be defined by or comprise an open hole section.

Figure 1C:
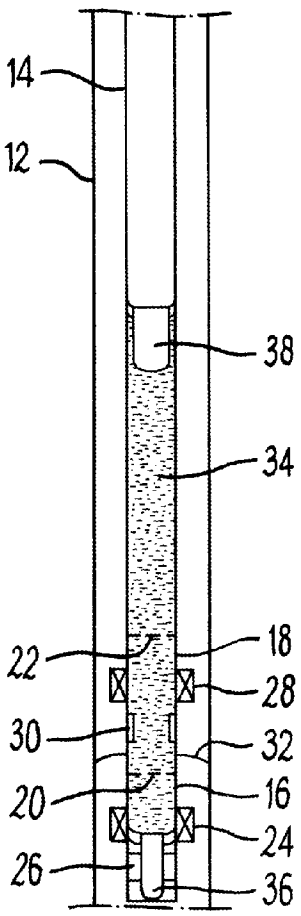
FIGS. 1A to 1F diagrammatically illustrate sequences of a method for establishing a barrier within a wellbore, in accordance with an embodiment of the present invention.
Figure 1B:
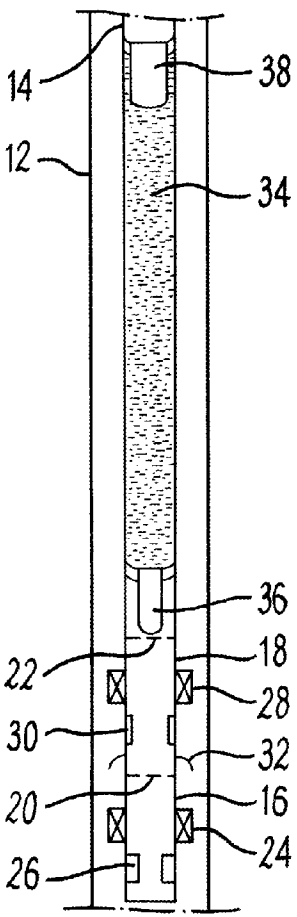
Figure 1A:
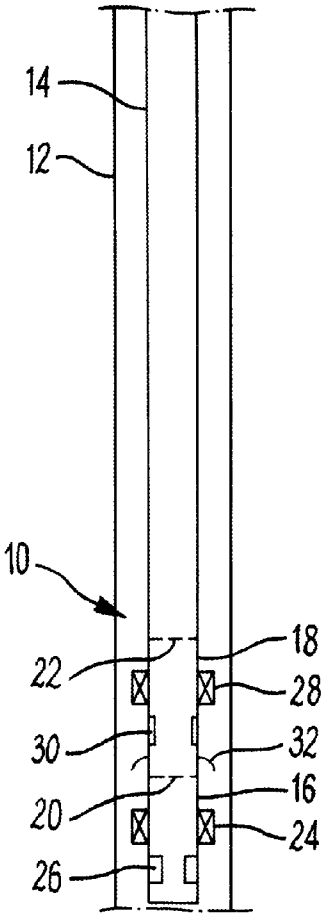

Referring initially to FIG. 1A, the apparatus 10 includes a running string 14 which supports at one end thereof first and second plug assemblies 16, 18. The running string includes a tubular body, such as coiled tubing. The first plug assembly 16 is secured below the second plug assembly via a first releasable connector 20, and the second plug assembly 18 is secured to the running string 14 via a second releasable connector 22. The first and second plug assemblies 16, 18 may be considered to form part of the running string when connected thereto.

The first plug assembly 16 includes a first extendable sealing arrangement 24 on an outer surface thereof, and a first internal dart seat 26. Similarly, the second plug assembly 18 includes a second extendable sealing arrangement 28 on an outer surface thereof, and a second internal dart seat 30, which is larger than the first dart seat 26. In the present embodiment the first and second sealing arrangements 24, 28 are formed of metal, but other materials may be used in alternative embodiments.

The second plug assembly 18 includes an extendable displacement barrier, which in the present embodiment is provided in the form of a swab cup 32 mounted on an outer surface of the second plug assembly 18.

Following appropriate make-up of the running string 14 and first and second plug assemblies 16, 18, the apparatus 10 is deployed into the tubing string 12 within the wellbore, to the required depth where a barrier is required, as illustrated in FIG. 1A. Subsequent to this, as illustrated in FIG. 1B, a volume of a settable medium, which in this embodiment is cement 34, in pumped through the running string 14 towards the plug assemblies 16, 18. The cement 34 is contained between a leading or first dart 36 and a trailing or second dart 38. It should be noted that the first dart 36 is of a smaller diameter then the second dart 38. A displacement fluid, such as a mud, is pumped above the second dart 38 to drive the entire cement/dart arrangement through the running string 14.

The cement/dart arrangement is driven through the running string 14 until the first dart 36 lands and sealingly engages with the first seat 26 of the first plug assembly 16, as illustrated in FIG. 1C. In this respect, the second seat 30 of the second plug assembly 18 is sufficiently larger than the first dart 36 to allow the first dart to pass therethrough. Furthermore, in the present embodiment, the first dart 36 upon passing through the second plug assembly 18 actuates the swab cup 32 to become extended and engage the wall of the tubing string 12.

Figure 1F:
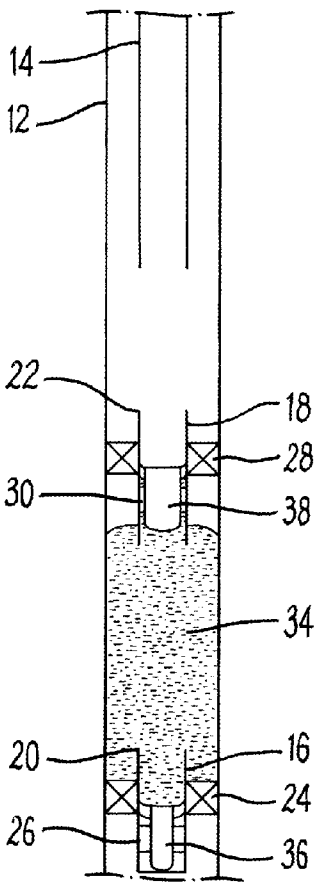
Figure 1E:
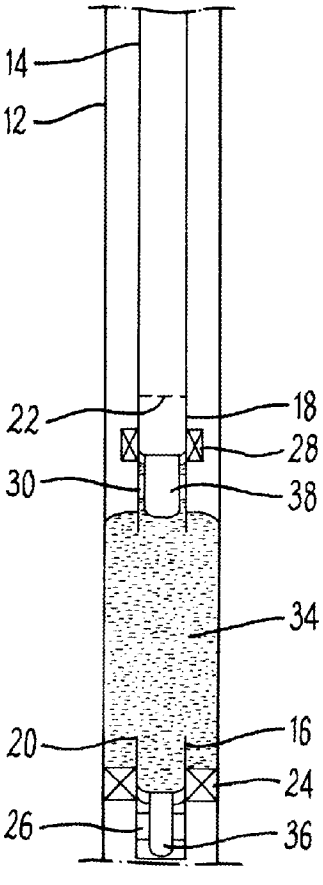
Figure 1D:
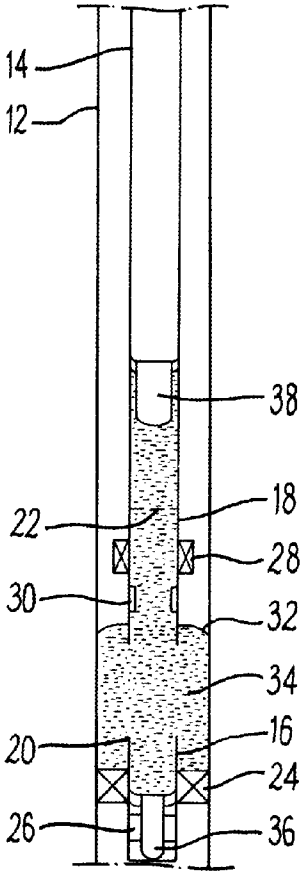

Subsequent to this, as illustrated in FIG. 1D, pressure applied against the first dart 36 from the cement 34 above causes the first extendable sealing arrangement 24 to be actuated and extended, via the first seat 26, to sealingly engage the wall of the tubing string 12. Such an arrangement provides a first set barrier in the wellbore.

Additionally, the running string 14 and the second plug assembly 18 are released form the set first plug assembly 16, via the releasable connector 20, allowing the cement 34 to be injected into the tubing string 12. The injected cement 34 is retained above the first plug assembly 16 by the extended sealing arrangement 24 and by the first dart 36 which is sealed within the first seat 26.

As the cement 34 is injected, the running string 14 and second plug 18 are displaced upwardly. In this respect, the injected cement 32 acts against the extended swab cup 32, allowing the cement 34 to displace the running string 14 and second plug 18. The swab cup 32 also functions to isolate the cement 34 from any resident wellbore fluids, and operates to wipe the inner surface of the tubing string 12. This assists to prevent contamination of the cement 34, and assists to provide a good bond between the cement 34 and the tubing string 12.

This injection of the cement 34 above the first plug assembly 16 may continue until the second dart 38 lands in the second seat 30 of the second plug assembly 18, as illustrated in FIG. 1E. Pressure applied behind the second dart 38 will cause the second extendable sealing arrangement 28 to be actuated and extended, via the second seat 30, to sealingly engage the wall of the tubing string 12, as illustrated in FIG. 1F. At this stage, the second plug assembly 18 may become set within the wellbore, providing a further barrier. More specifically, at this stage three distinct but synergistic barriers are created: the first by the first plug assembly 16; the second by the cement 34; and the third by the second plug assembly 18. This may provide a very robust wellbore barrier. Furthermore, this may provide a very good degree of contingency in the event of failure or compromise of one of the barriers. Also, the complete barrier may be established during a single operation, providing significant advantages in terms of reducing operator time and associated costs.

As also shown in FIG. 1F, following completion of the barrier, the running string 14 may be released form the second plug assembly 18 via the second releasable connector 22. The running string 14 may be returned to surface.

Figure 2B:
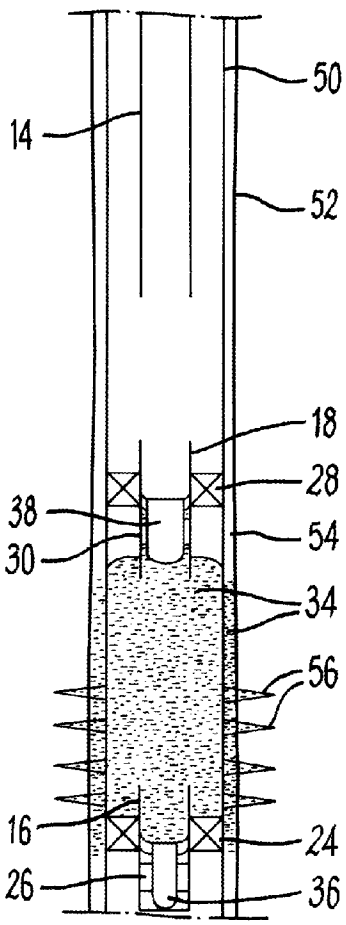
FIGS. 2A and 2B diagrammatically illustrate sequences of a method for establishing a barrier within a wellbore, in accordance with an alternative embodiment of the present invention.
Figure 2A:
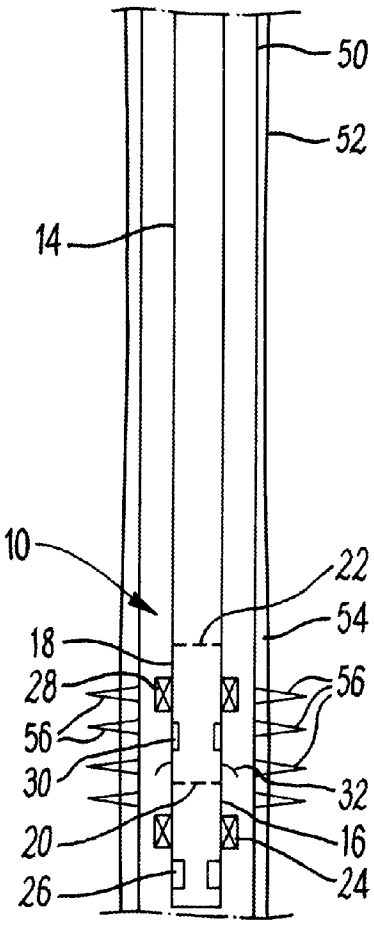

Sequential steps of a method for providing a barrier in a wellbore in accordance with an alternative embodiment of the present invention is illustrated in FIGS. 2A and 2B.

Referring initially to FIG. 2A, the same apparatus 10 as illustrated in FIG. 1 is run into a tubing string 50 which is located within a drilled bore 52, with an annulus region 54 defined between the tubing string 50 and the drilled bore 52. Perforations 56 extend through a wall of the tubing string 50 to provide communication with the annulus 54. The apparatus 10 may be operated in the same manner and procedural steps as illustrated in FIGS. 1B to 1F to form a barrier within the tubing string 50. However, in this case, as illustrated in FIG. 2B, the cement 34 is also injected into the annulus 54 via the perforations 56, thus providing a very robust wellbore barrier.

Figure 3C:
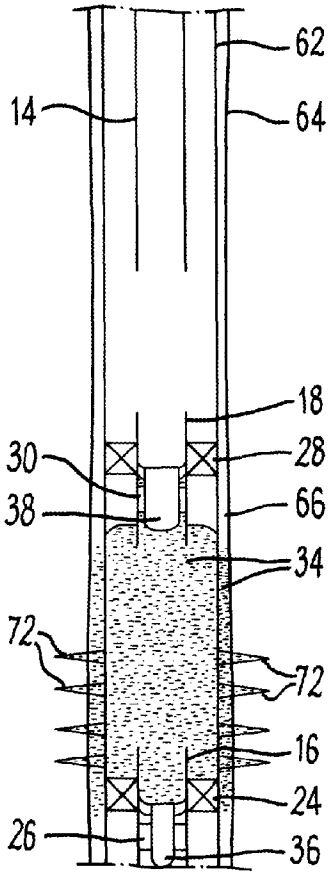
FIGS. 3A, 3B and 3C diagrammatically illustrate sequences of a method for establishing a barrier within a wellbore, in accordance with a further alternative embodiment of the present invention.
Figure 3B:
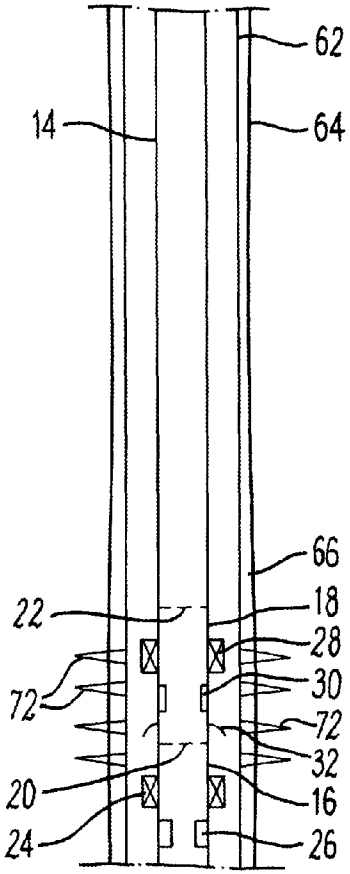
Figure 3A:
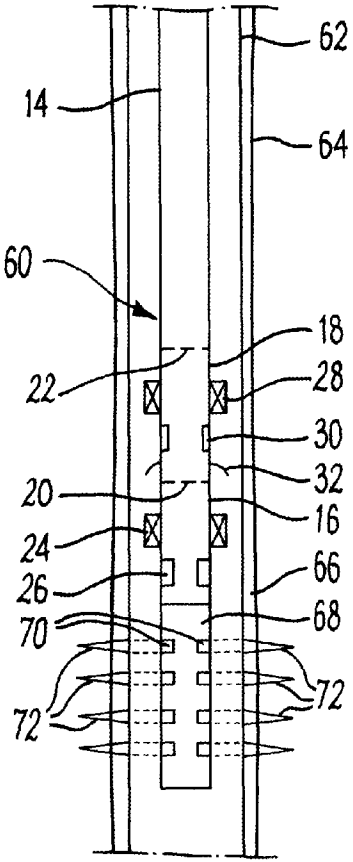

Sequential steps of a method for providing a barrier in a wellbore in accordance with a further alternative embodiment of the present invention is illustrated in FIGS. 3A to 3C.

Referring initially to FIG. 3A, an apparatus 60 according to an embodiment of the present invention is positioned within a wellbore, specifically within a tubing string 62 which extends through a drilled bore 64 to define an annulus 66 therebetween. The apparatus is similar in many respects to the apparatus 10 of FIG. 1, and likewise includes the same running string 14, the same first plug assembly 16 and the same second plug assembly 18. However, the apparatus 60 further includes a perforating tool 68 which is secured below the first plug assembly 16. In other embodiments the perforating tool may be located at any position within the apparatus 60, for example above the first plug assembly 16.

When the apparatus 60 is located at the required depth, the perforating tool 68 is activated, for example via a detonator (not shown), to fire a number of explosive charges 70, for example shaped charges, to create a number of perforations 72 through the wall of the tubing string 62, creating a communication path with the annulus 66. Once the perforations 72 have been established, the apparatus 60 is deployed further into the wellbore, as illustrated in FIG. 3B, to align the first plug assembly 16 as required. The apparatus 60 may then be operated in the same procedures as illustrated in FIGS. 1B to 1F to form a barrier within the tubing string 62. However, in this case, as illustrated in FIG. 3C, the cement 34 is also injected into the annulus 66 via the perforations 72, thus providing a very robust wellbore barrier.

It should be understood that the embodiments described herein are merely exemplary and that various modifications may be made thereto without departing from the scope of the invention. For example, the swab cup 32 is optional, and may be omitted. Furthermore, in some embodiments the sealing arrangement 28 of the second plug assembly may be partially set to provide a displacement barrier to allow the cement to displace the running string during injection.

In other embodiments the staged sequence of setting individual barriers may be repeated, using third and subsequent plug assemblies.

Also, although the specific embodiment of setting a barrier for well abandonment is described, other applications are possible, such as setting a barrier during well construction, for example during completion of a wellbore. In some examples a barrier may be desired to be set at the toe region of a wellbore.

In some embodiments it may be desirable to subsequently remove the barrier. Such removal may be achieved by drilling or milling the barrier. In this respect, the plug assemblies may be formed of a drillable material, such as aluminium of the like.

The invention claimed is:

1. A method off setting a barrier within a wellbore, comprising:

deploying a running string into a wellbore, wherein the running string comprises a first plug assembly connected to the running string and a second plug assembly connected to the running string above the first plug assembly, the first and second plug assemblies comprising respective extendable arrangements;

setting the first plug assembly within the wellbore by extending its respective extendable arrangement;

injecting a settable medium via the running string above the first plug assembly;

providing a displacement barrier or restriction on the running string, wherein the displacement barrier is acted upon by the settable medium during injection, to facilitate or assist with displacement of the running string along the wellbore;

displacing the running string by the injected settable medium; and setting the second plug assembly within the wellbore by extending its respective extendable arrangement during or after injection of the settable medium.

2. The method according to claim 1, wherein the settable medium is selected from the group consisting of: cement, an epoxy, and/or a gel.

3. The method according to claim 1, wherein the first plug assembly comprises a respective first extendable arrangement which is configured to provide sealing with a wall of the wellbore, and a respective second extendable arrangement which is configured to provide an anchor within the wellbore.

4. The method according to claim 3, wherein the respective extendable arrangements of the first and/or second plug assemblies comprise a radially extendable structure comprising a deformable structure configured to be deformed to become radially extended, and the method comprises radially extending the radially extendable structure by application of an axial actuation force.

5. The method according to claim 4, wherein the radially extendable structure comprises a bellows construction.

6. The method according to claim 1, wherein the extendable arrangement comprises a metal structure, and the method comprises engaging the extendable arrangement with a metal wellbore structure to create a metal-to-metal seal.

7. The method according to claim 1, wherein the extendable arrangement comprises a hybrid metal and non-metal construction and the method comprises engaging the extendable arrangement with a wellbore structure to create a hybrid metal and non-metal seal.

8. The method according to claim 1, wherein the displacement barrier comprises an extendable structure provided on or otherwise associated with the running string, and wherein the displacement barrier extendable structure is activated to be extended prior to or during injection of the settable medium.

9. The method according to claim 8, wherein the displacement barrier extendable structure comprises or is defined by an extendable arrangement of the second plug assembly.

10. The method according to claim 1, wherein the displacement barrier extends from the running string to engage a wall of the wellbore, and functions to wipe the wall of the wellbore during displacement of the running string.

11. The method according to claim 1, further comprising releasing the running string and the second plug assembly from the first plug assembly, and moving the second plug assembly relative to the first plug assembly.

12. The method according to claim 1, further comprising injecting the settable medium within an axial space between the first and second plug assemblies.

13. The method according to claim 1, wherein the second plug assembly comprises a respective first extendable arrangement which is configured to seal with a wall of the wellbore, and a respective second extendable arrangement which is configured to provide an anchor within the wellbore.

14. The method according to claim 1, wherein the second plug assembly comprises an extendable arrangement which slidingly contacts a wall of the wellbore.

15. The method according to claim 1, wherein the second plug assembly comprises an extendable arrangement, and the method comprises at least partially extending the extendable arrangement of the second plug assembly to define the displacement barrier.

16. The method according to claim 15, further comprising partially extending the extendable arrangement of the second plug assembly to define the displacement barrier and subsequently fully or more completely extending the extendable arrangement to set the second plug assembly within the wellbore.

17. The method according to claim 1, wherein after setting the first plug assembly within the wellbore by extending its respective extendable arrangement, the method further comprises releasing the running string and the second plug assembly from the first plug assembly, and wherein after the running string and the second plug assembly have been released from the first plug assembly, injecting the settable medium via the running string above the first plug assembly causes the running string and the second plug assembly to move relative to the first plug assembly.

18. The method according to claim 1, further comprising providing further plug assemblies.

19. The method according to claim 1, comprising setting a barrier during a well abandonment operation.

20. The method according to claim 1, comprising setting a barrier as part of a wellbore construction operation.

* * * * *